US007727000B2

(12) United States Patent
Minich

(10) Patent No.: US 7,727,000 B2
(45) Date of Patent: Jun. 1, 2010

(54) ELECTRICAL CONNECTOR HAVING GUIDANCE FOR MATING

(75) Inventor: Steven E. Minich, York, PA (US)

(73) Assignee: FCI Americas Technology, Inc., Carson City, NV (US)

( * ) Notice: Subject to any disclaimer, the term of this patent is extended or adjusted under 35 U.S.C. 154(b) by 107 days.

(21) Appl. No.: 11/968,484

(22) Filed: Jan. 2, 2008

(65) Prior Publication Data

US 2009/0170351 A1 Jul. 2, 2009

(51) Int. Cl.
*H01R 13/64* (2006.01)

(52) U.S. Cl. ..... 439/377

(58) Field of Classification Search ..... 439/79, 439/65, 101, 108, 541.5, 843, 378, 377
See application file for complete search history.

(56) References Cited

U.S. PATENT DOCUMENTS 4,820,169 A * 4/1989 Weber et al. ..... 439/65
5,391,091 A * 2/1995 Nations ..... 439/378
5,575,690 A 11/1996 Eaton
5,888,101 A * 3/1999 Dent et al. ..... 439/680
6,065,992 A * 5/2000 Wu et al. ..... 439/383
6,135,816 A * 10/2000 Mashiyama ..... 439/607.01
6,607,308 B2 8/2003 Dair et al.
6,811,414 B1 11/2004 Consoli et al.
6,875,031 B1 * 4/2005 Korsunsky et al. ..... 439/79
7,070,464 B2 * 7/2006 Clark et al. ..... 439/825
7,186,121 B1 * 3/2007 Costello et al. ..... 439/79
2006/0079113 A1 * 4/2006 Minich ..... 439/378

* cited by examiner

*Primary Examiner*—Chandrika Prasad
(74) *Attorney, Agent, or Firm*—Woodcock Washburn LLP

(57) ABSTRACT

Disclosed is an electrical connector assembly adapted to isolate shock forces during mating. Such an electrical connector assembly may include a first electrical connector, a second electrical connector, and a first guide module. The second electrical connector may be adapted to mate with the first electrical connector. The first guide module may be located adjacent to the first electrical connector and may include an opening for receiving a first guide post. There may be no direct mechanical attachment between the first electrical connector and the first guide module. Such an arrangement, may isolate the first electrical connector from any forces created by the mating of the guide post with the opening of the guide module.

24 Claims, 10 Drawing Sheets

ELECTRICAL CONNECTOR HAVING GUIDANCE FOR MATING

BACKGROUND

A monoblock electrical connector may be used to establish a conductive connection between a daughter card and a back-panel board. An example monoblock connector may include an array of right angle connector modules. The connector modules may be adapted to mate with complementary connector modules of a second electrical connector. The connector modules that form the monoblock connector may be mechanically attached to one or more guide modules. The guide modules may be adapted to mate with guide posts extending from the second electrical connector.

When such a monoblock connector is mated with a complementary connector, the mating forces created by the mating of the guide posts with the guide modules, may be applied directly to mounting ends of the connector modules of the monoblock electrical connector. This may occur because the guide modules are mechanically attached directly to the connector modules of the monoblock electrical connector. As a result, the mounting ends of the connector modules may be damaged during mating.

SUMMARY

An electrical connector assembly adapted to isolate shock forces during mating is disclosed. Such an electrical connector assembly may include a first electrical connector, a second electrical connector, and a first guide module. The second electrical connector may be adapted to mate with the first electrical connector. The first guide module may be located adjacent to the first electrical connector and may define an opening for receiving a guide post. There may be no direct mechanical attachment between the first electrical connector and the first guide module. Such an arrangement, may isolate the first electrical connector from any forces created by the mating of the guide post with the opening of the guide module.

DETAILED DESCRIPTION OF ILLUSTRATIVE EMBODIMENTS

Figure 1:
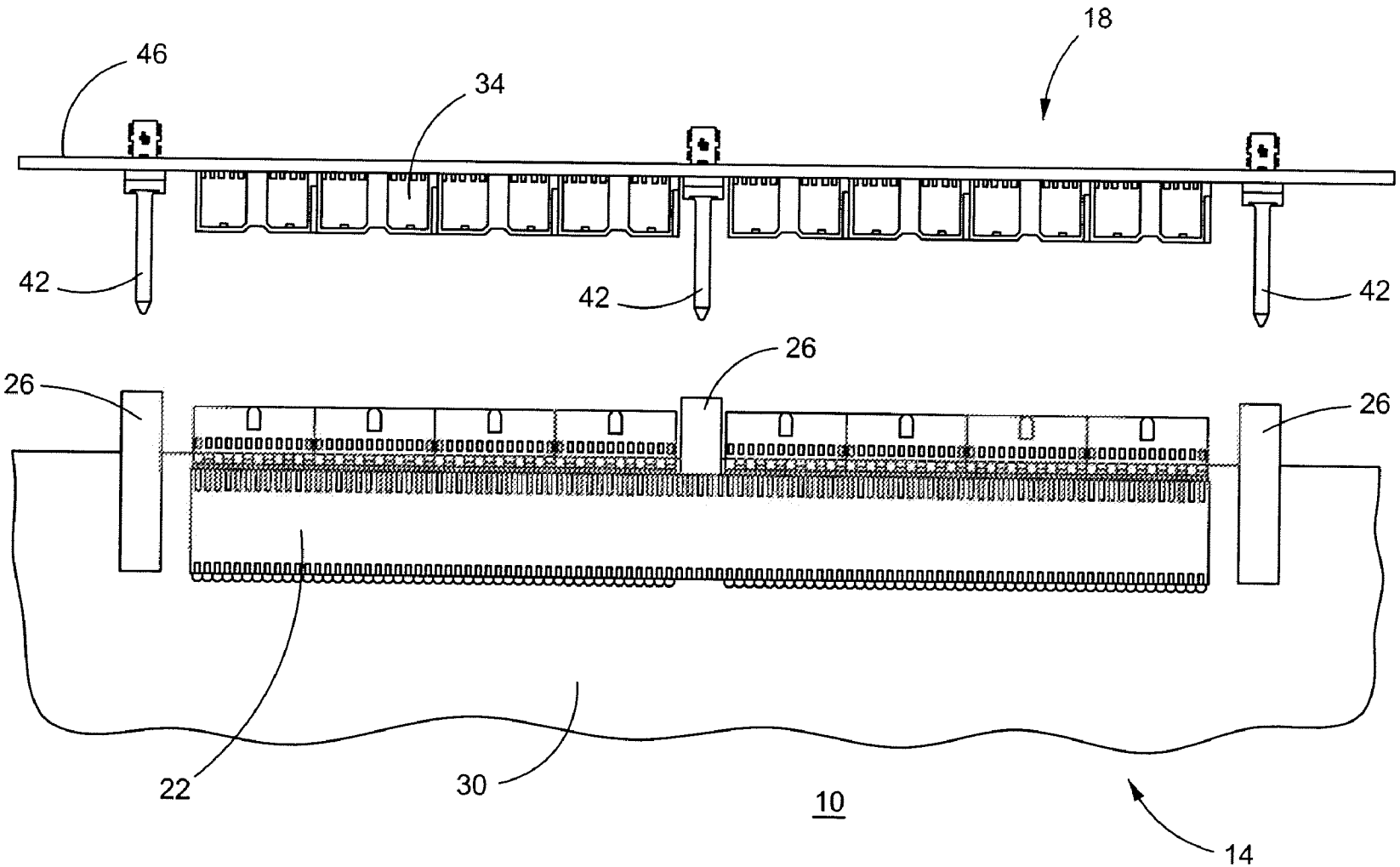
FIG. 1 is a top view of an example electrical connector assembly.

FIG. 1 depicts an example electrical connector assembly adapted to isolate shock forces during mating. As shown, an electrical connector assembly 10 may include a first connector assembly 14, and a second connector assembly 18. The first connector assembly 14 may be adapted to mate with the second connector assembly 18.

As shown, the first connector assembly 14 may include a first monoblock electrical connector 22, and one or more guide modules 26. The first electrical connector 22 and the guide modules 26 may be mounted on a first circuit board 30, which may be a daughter card, for example.

As shown, the second connector assembly 18 may include a second monoblock electrical connector 34, and one or more guide posts 42. The second electrical connector 34 and the guide posts 42 may be mounted on a second circuit board 46, which may be a back-panel board, for example. The second connector assembly 18 may have as many guide posts 42 as there are guide modules 26 found in the first connector assembly 14.

The first connector assembly 14 may be adapted to mate with the second connector assembly 18. For example, the first electrical connector 22 of the first connector assembly 14 may be adapted to mate with a complementary second electrical connector 34 of the second connector assembly 18, and so on. Each of the guide posts 42 may be adapted to mate with a respective guide module 26. Thus, the electrical connector assembly 10 may be formed.

Figure 2A:
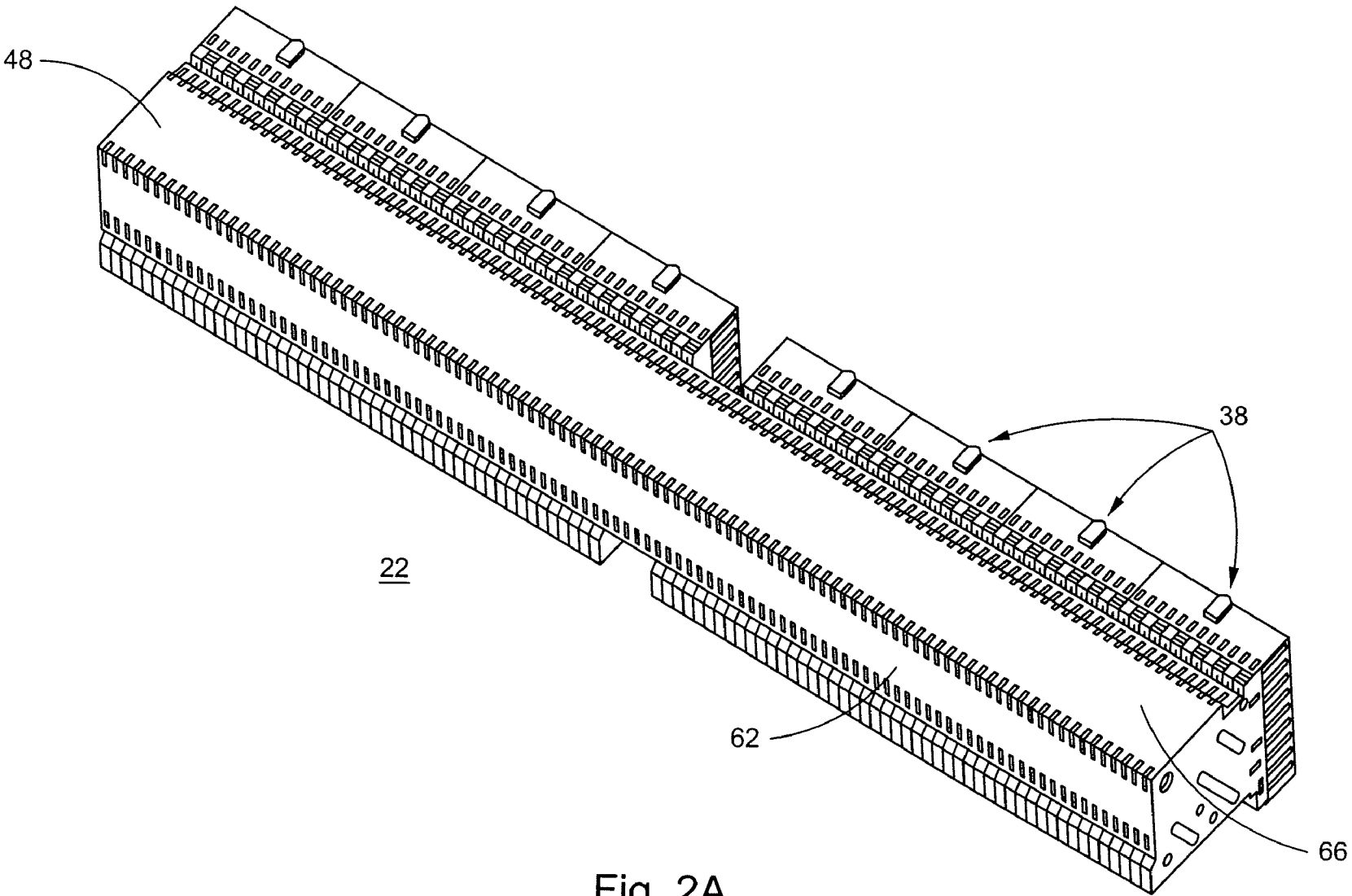
FIG. 2A is an isometric view of an example electrical connector.

FIG. 2A is an isometric view depicting the first electrical connector 22 of the first connector assembly 14. As shown, the first electrical connector 22 may include an array of connector modules 38. The connector modules 38, may be attached to each other by a connector module organizer 48. The organizer 48 may help align the connector modules 38. The rigidity of the organizer 48 may serve to stiffen the edge of the circuit board 30 after the electrical connector 22 has been mounted onto the circuit board 30.

Figure 2B:
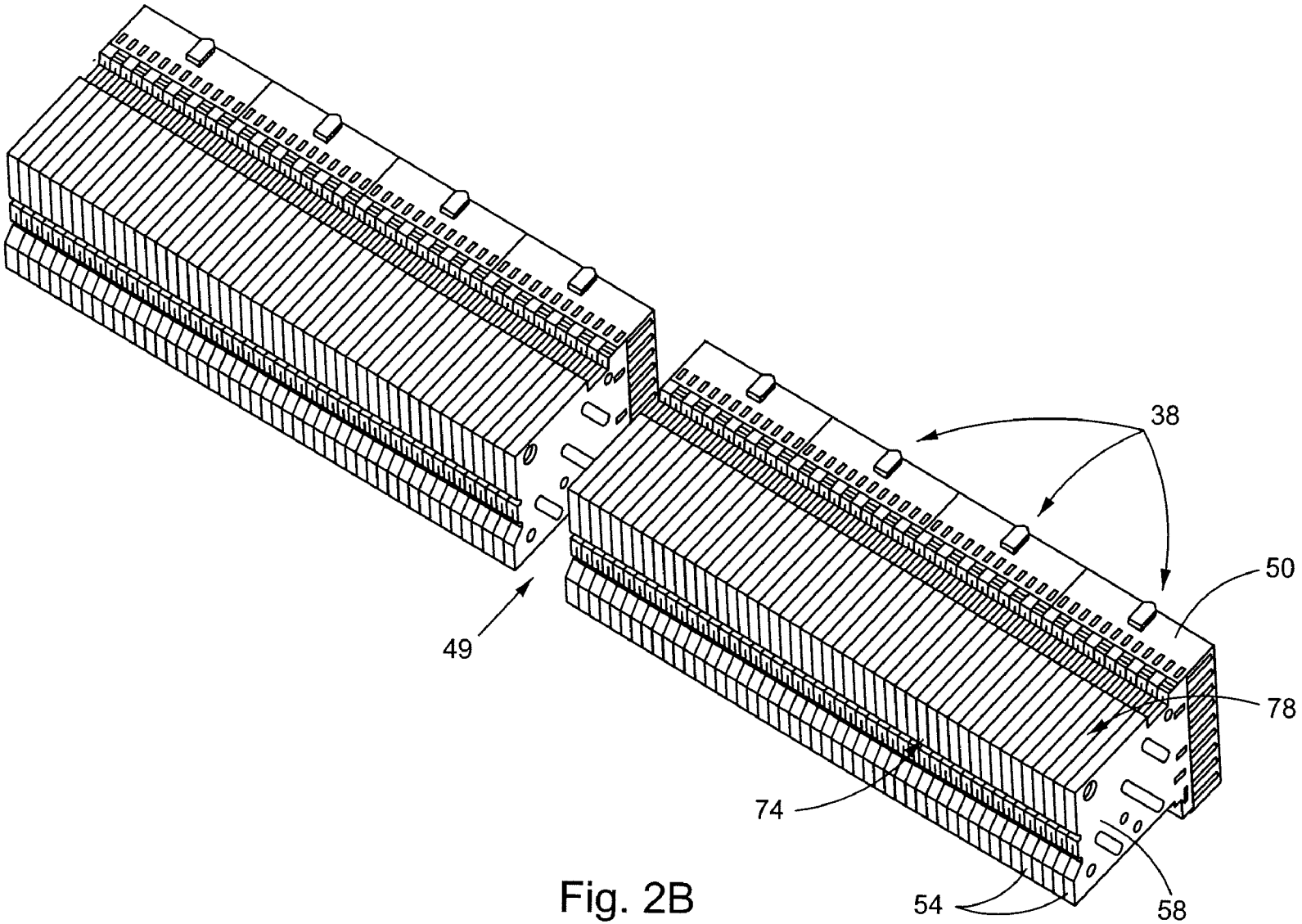
FIG. 2B is an isometric view of the electrical connector of FIG. 2A without a connector module organizer.

FIG. 2B depicts the first electrical connector 22 without the organizer 48. As shown, each connector module 38 may be a right angle connector. The connector modules 38 may be arranged such that a gap 49 is formed between two adjacent connector modules 38. The first electrical connector 22 is shown as defining only one gap 49. It should be appreciated, however, that the first electrical connector 22 may define any number of gaps 49.

Each connector module 38 may include a housing 50, and a plurality of leadframe assemblies 54 received in the housing 50. Each housing 50 may be made of a dielectric material such as plastic, for example. Each leadframe assembly 54 may include a leadframe housing 58, and a plurality of electrically-conductive contacts (not shown) extending through the leadframe housing 58. Each electrically-conductive contact may include a mating end (not shown) and a mounting end (not shown). The mounting ends may be adapted to mate with the first circuit board 30.

Figure 3:
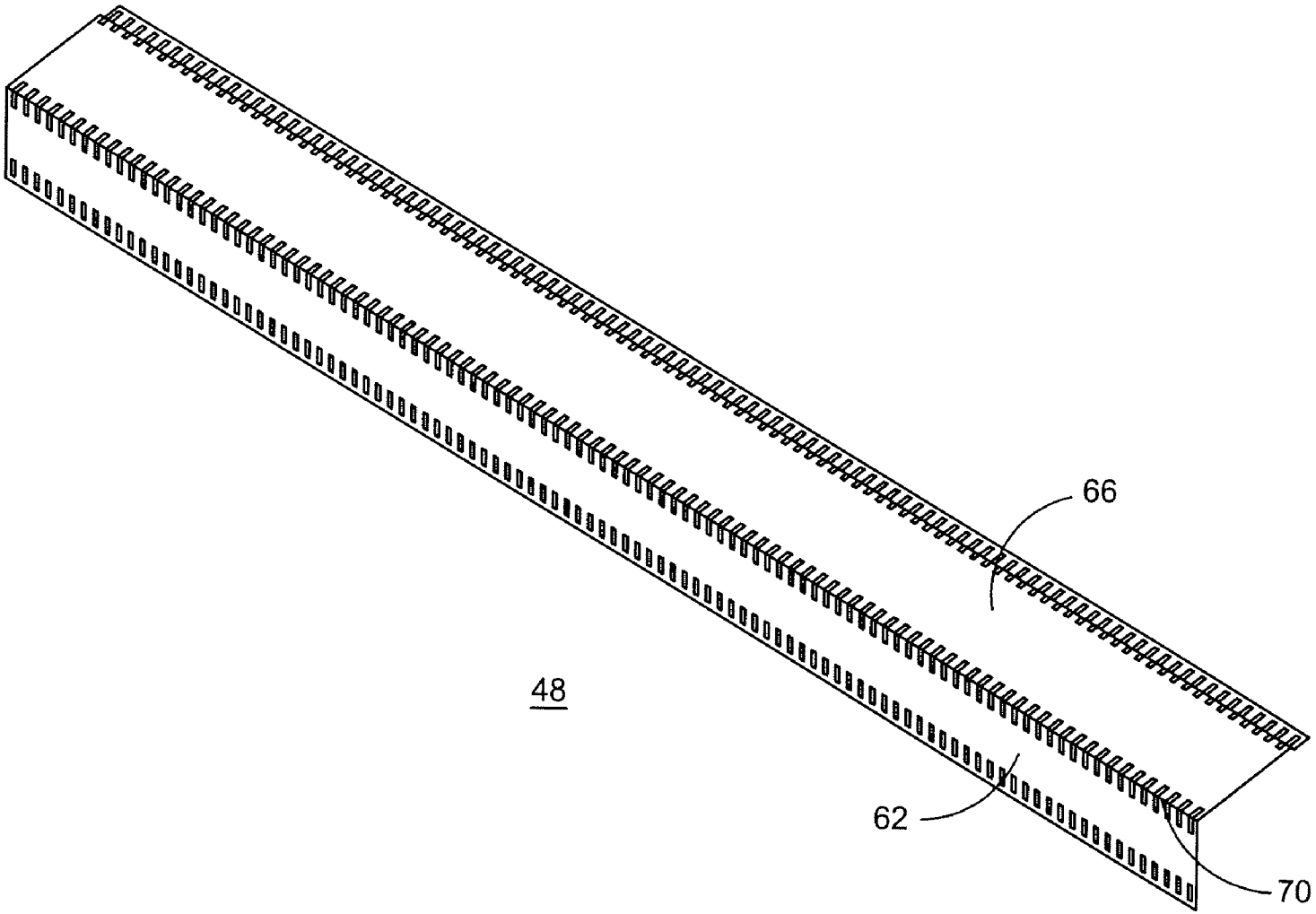
FIG. 3 is an isometric view of an example connector module organizer.

FIG. 3 depicts the organizer 48. The organizer 48 may help align and attach the connector modules 38 to each other to form the first electrical connector 22. The entire first electrical connector 22 may then be press fitted to a printed circuit board with minimal displacement or bowing of the leadframe assemblies 54 of the connector modules 38. The organizer 48 may also reinforce the leadframe assemblies 54, as the first electrical connector 22 is being mated with a second electrical connector. Additionally, the organizer 48 may be made of an electrically-conductive material, such as metal, for example. Such metal organizers 48 may be adapted to electrically connect the leadframe assemblies 54.

As shown in FIG. 3, the organizer 48 may include a first planar member 62, and a second planar member 66 extending from a first end 70 of the first planar member 62. The first planar member 62 may form a 90-degree angle with the second planar member 66. Referring back to FIGS. 2A and 2B, the first planar member 62 may attach to a back side 74 of the leadframe assemblies 54. The second planar member 66 may attach to a top side 78 of the leadframe assemblies 54. Accordingly, all of the leadframe assemblies 54, and thereby all of the connector modules 38, may be connected as a single electrical connector.

Figure 4:
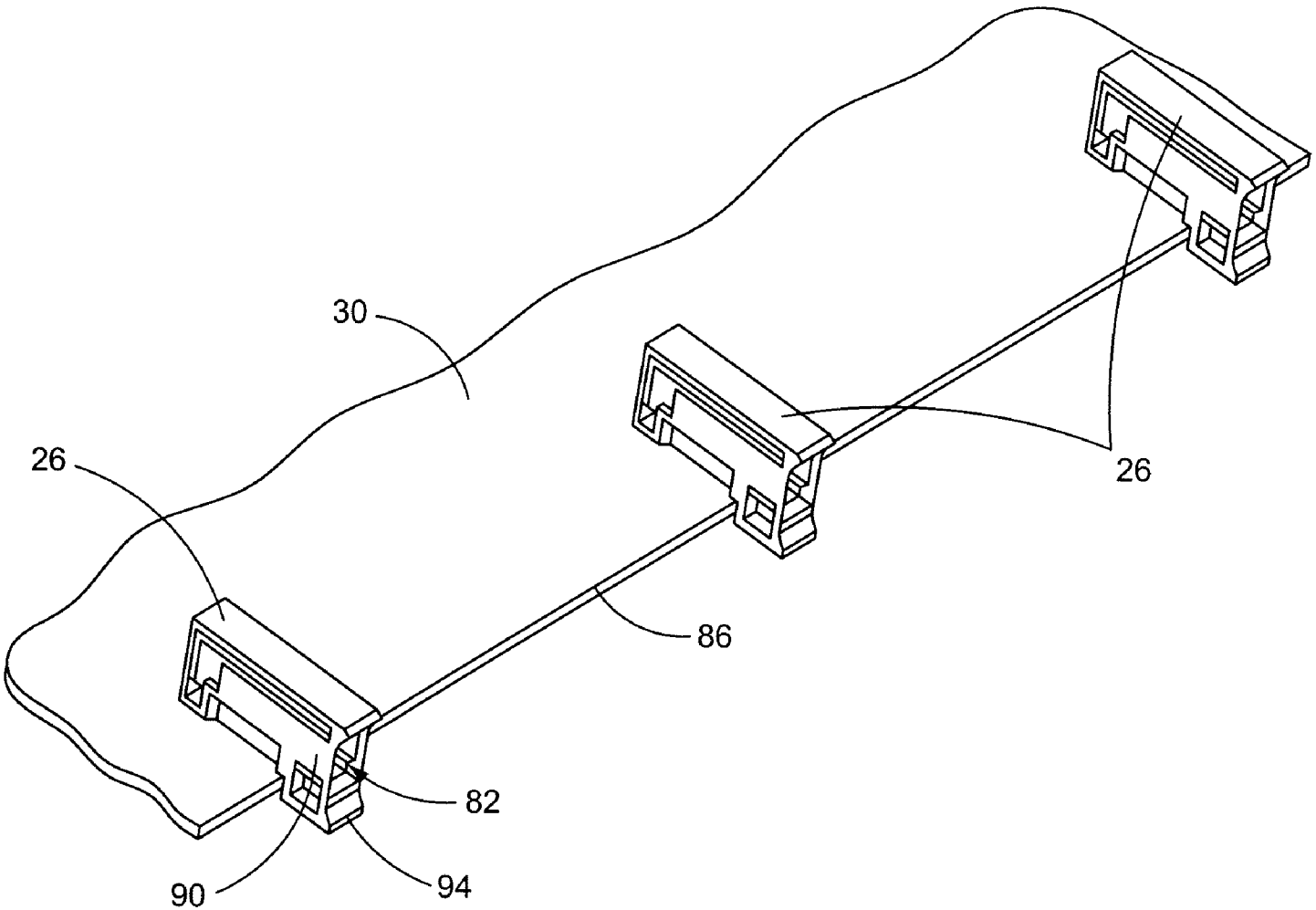
FIG. 4 is an isometric view of guide modules mounted on a first circuit board.

FIG. 4 depicts three guide modules 26 mounted on the first circuit board 30. As shown, the guide modules 26 may each include an opening 82. The openings 82 may be adapted to receive a respective guide post from a second connector assembly. The guide modules 26 may be made of a durable material, such as metal, for example, and may be die cast.

The guide modules 26 may be mounted on an edge 86 of the first circuit board 30. When the guide modules 26 are mounted on the first circuit board 30, a front portion 90 of the guide modules 26 may protrude past the edge 86 of the first circuit board 30. Furthermore, a bottom portion 94 of the front portion 90 may protrude in a downward direction below the edge 86 of the first circuit board 30.

Figure 5A:
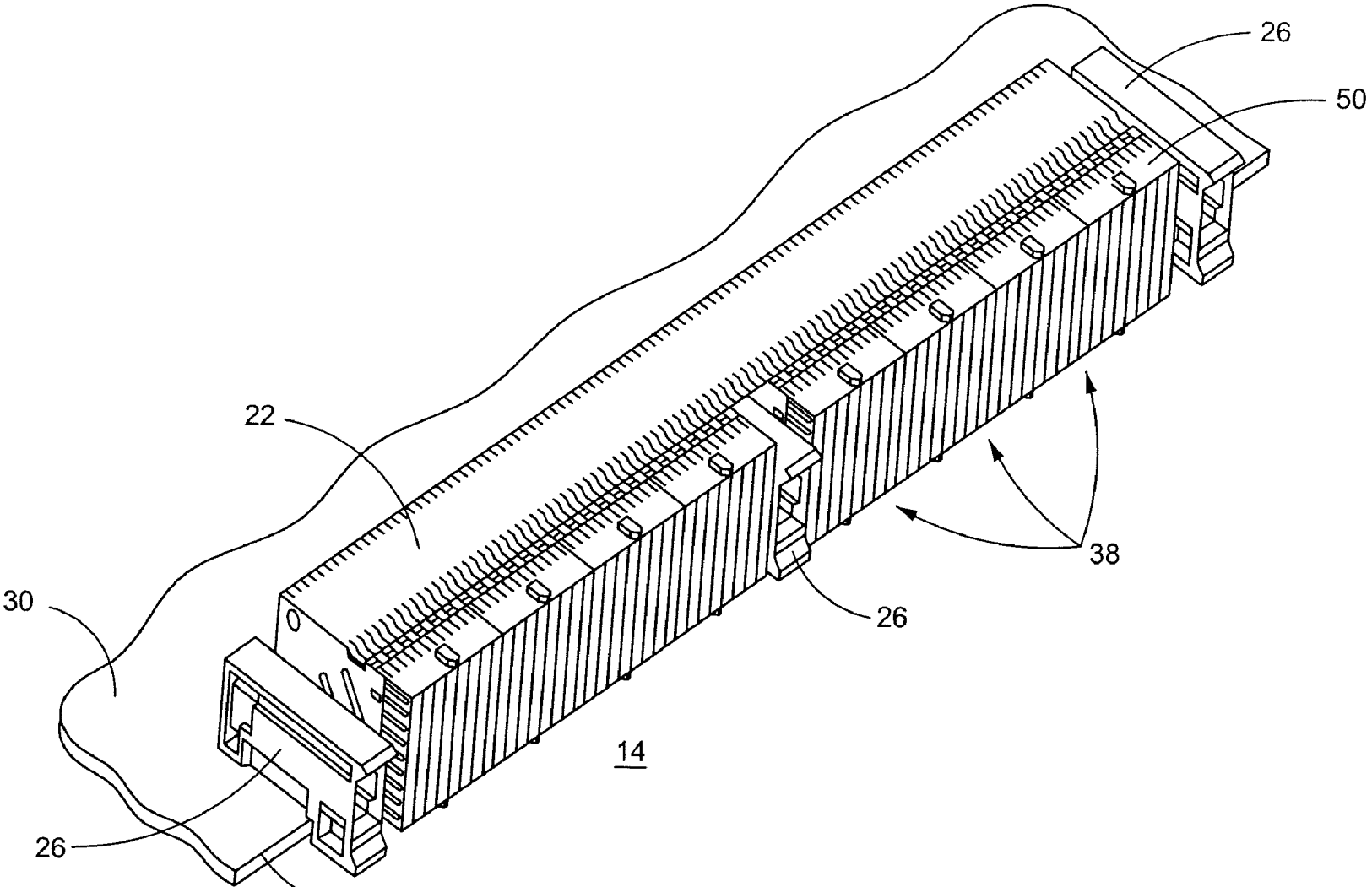
FIG. 5A is an isometric view of the electrical connector of FIG. 2A mounted on the first circuit board of FIG. 4 to form an example first connector assembly.
Figure 5B:
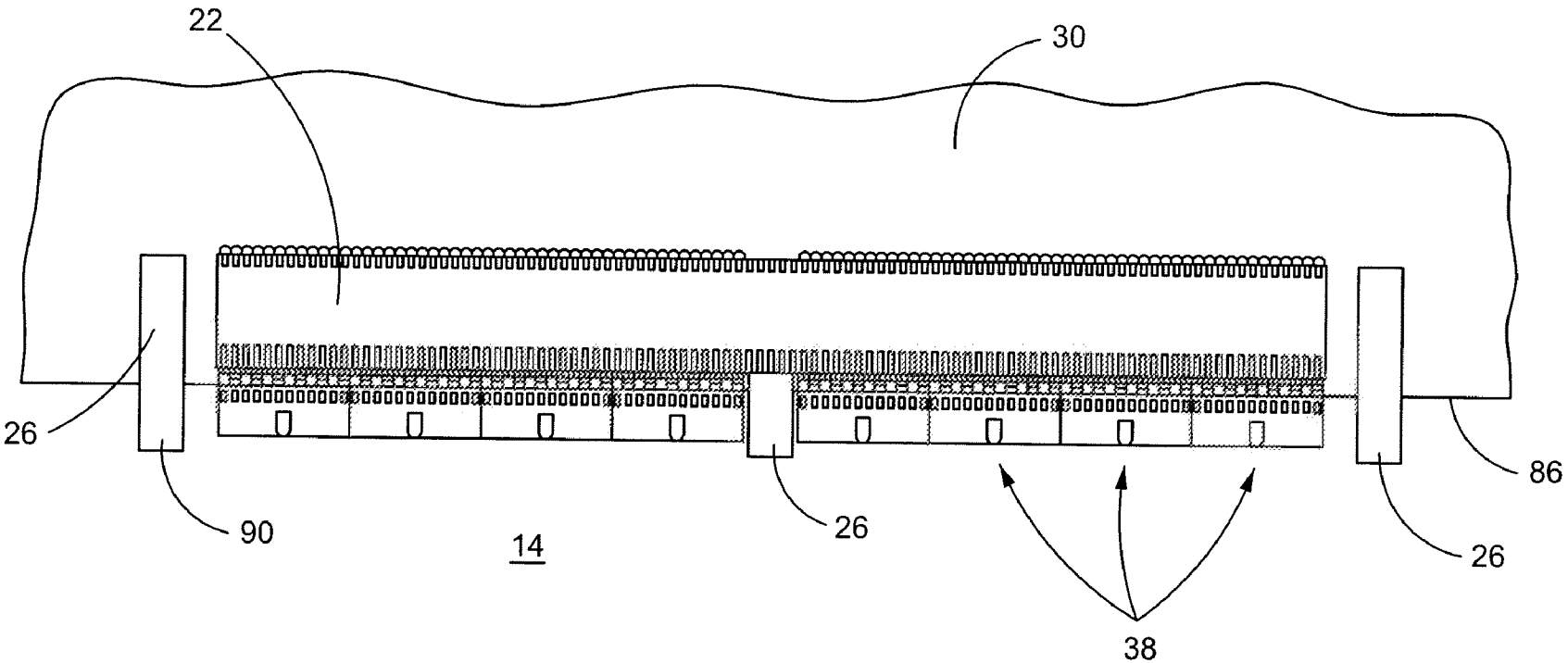
FIG. 5B is a top view of the first connector assembly of FIG. 5A.
Figure 5C:
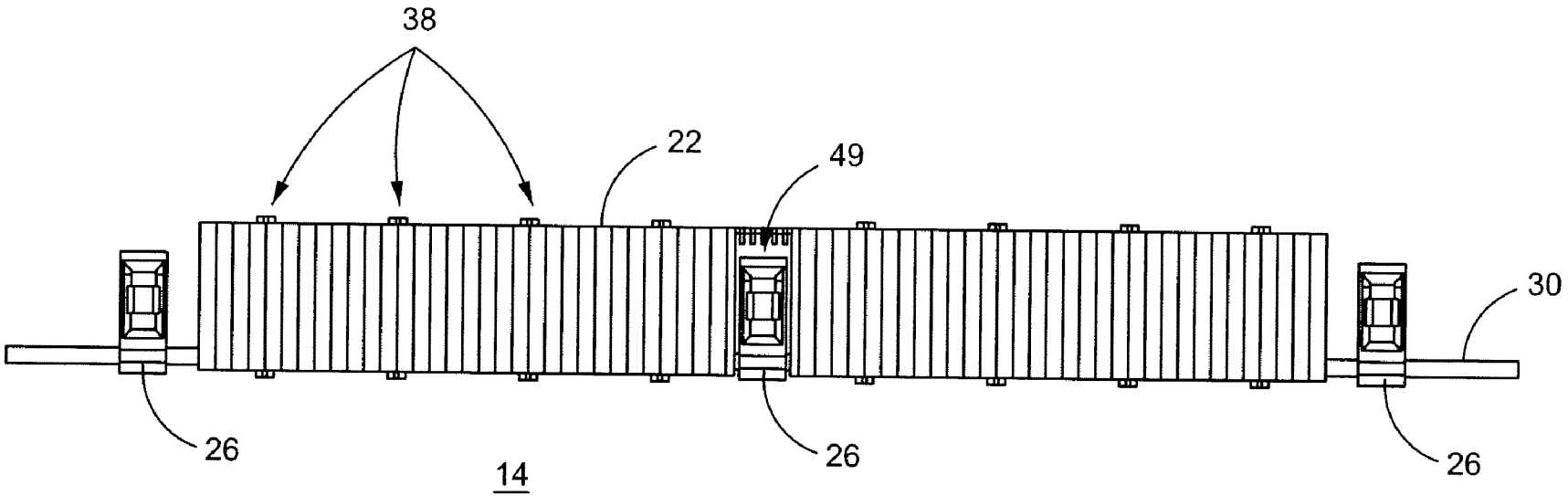
FIG. 5C is a front view of the first connector assembly of FIG. 5A.

FIGS. 5A-5C depict the first electrical connector 22 mounted on the first circuit board 30 along with the guide modules 26, to form the first connector assembly 14. As shown, the first electrical connector 22 may be mounted on the edge 86 of the first circuit board 30. When the first electrical connector 22 is mounted on the first circuit board 30, a portion of the first electrical connector 22 may protrude past the edge 86 of the first circuit board 30. For example, the housings 50 of the connector modules 38 of the first electrical connector 22 may protrude past the edge 86 of the first circuit board 30. As shown in FIG. 5B, the front portions 90 of the guide modules 26 may protrude further past the edge 86 of the first circuit board 30 than the first electrical connector 22. Such an arrangement may help protect the connector modules 38 during any rough handling prior to assembly into a system.

As shown in FIG. 5C, when the first electrical connector 22 is mounted onto the first circuit board 30 one of the guide modules 26 may be located in the gap 49 formed between two of the connector modules 38, and two of the guide modules 26 may be located at opposite ends of the first electrical connector 22. Depending on the design of the first electrical connector 22, the first connector assembly 14 may have to be assembled in a certain order. For example, it may be necessary to mount the guide module 26 located in the gap 49 formed between the two connector modules 38 onto the first circuit board 30 before the first electrical connector 22 is mounted onto the first circuit board 30. On the other hand, the guide modules 26 located at either end of the first electrical connector 22 may be mounted onto the first circuit board 30 either before or after the first electrical connector 22 is mounted onto the first circuit board 30.

The guide modules 26 and the first electrical connector 22 may be arranged such that there is no direct mechanical attachment between the guide modules 26 and the first electrical connector 22. For example, the guide modules 26 may not be mechanically attached directly to the connector modules 38 of the first electrical connector 22. Similarly, the guide modules 26 may not be mechanically attached directly to the organizer 48.

Figure 6A:
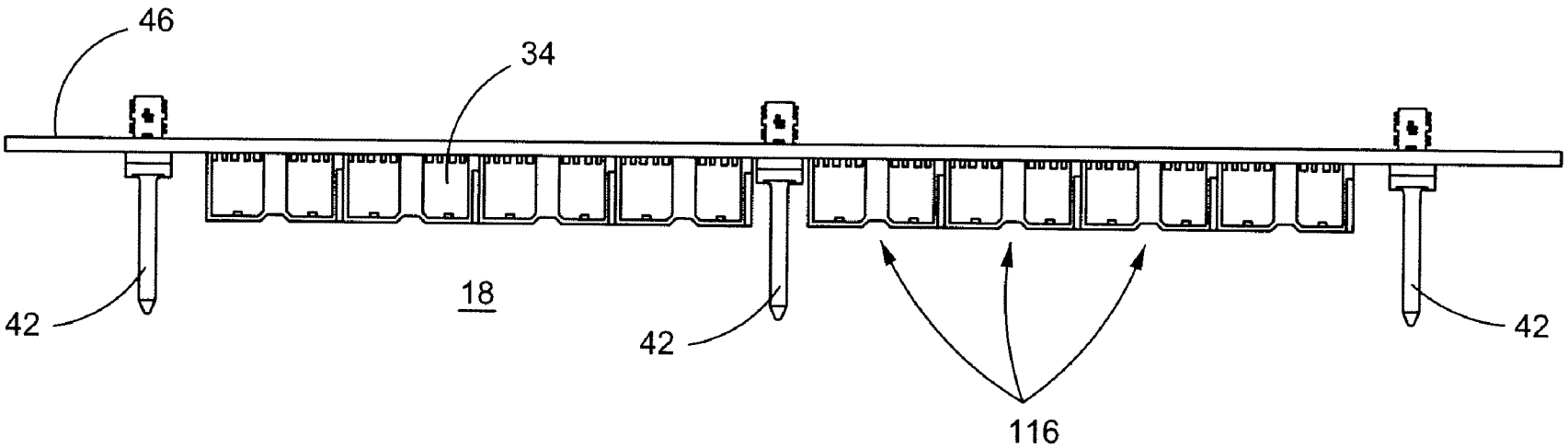
FIG. 6A is a top view of a second connector assembly.
Figure 6B:
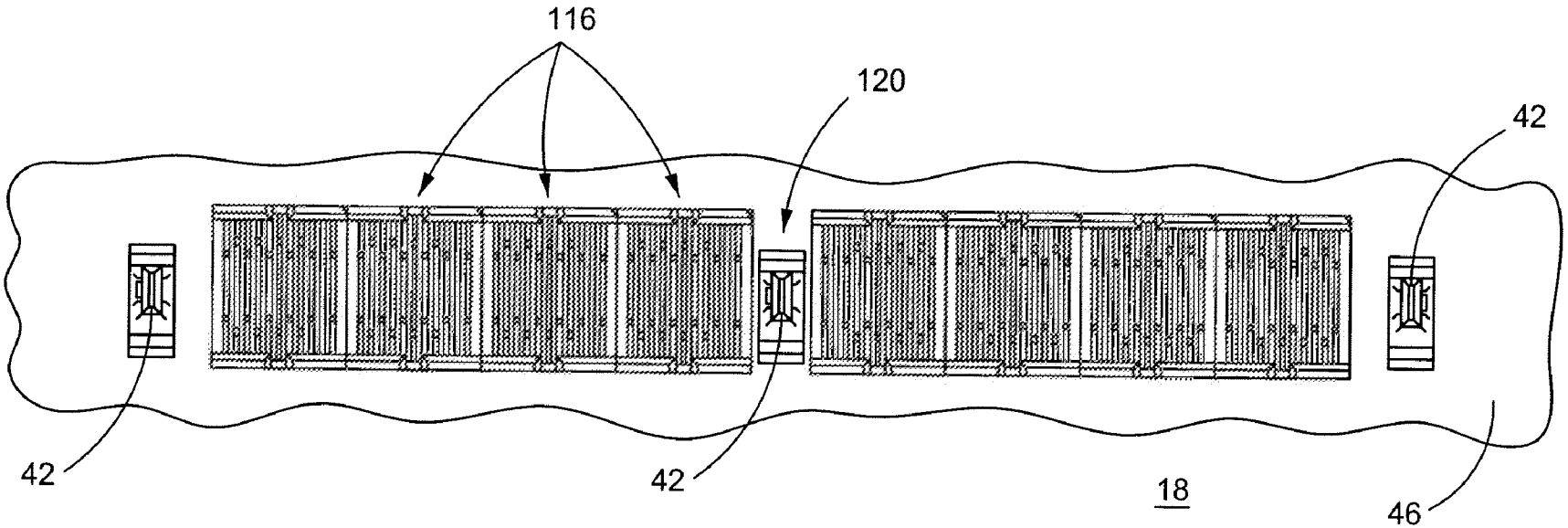
FIG. 6B is a front view of the second connector assembly of FIG. 6A.

FIGS. 6A and 6B depict the second connector assembly 18. As shown, the second connector assembly 18 may include a second electrical connector 34 and guide posts 42. The second electrical connector 34 and the guide posts 42 may be mounted onto a second circuit board 46. It should be appreciated that the guide posts 42 could extend from the second electrical connector 34.

The second electrical connector 34 may include several connector modules 116. Each connector module 116 may be adapted to mate with a corresponding connector module 38 of the first connector assembly 14. Similar to the first electrical connector 22, the modules 116 of the second electrical connector 34 may be arranged such that a gap 120 is formed between two adjacent modules 116.

The guide posts 42 may be arranged on the second circuit board 46 so that each guide post 42 may mate with a corresponding guide module 26 of the first connector assembly 14, when the first connector assembly 14 is mated with the second connector assembly 18. For example, in order to for the first connector assembly 14 to mate with second connector assembly 18, one of the guide posts 42 may be located in the gap 120 and two additional guide posts 42 may be located at either end of the second electrical connector 34.

The guide posts 42 and the second electrical connector 34 may be arranged such that there is no direct mechanical attachment between the guide posts 42 and the second electrical connector 34. For example, the guide posts 42 may not be mechanically attached directly to the modules 116 of the second electrical connector 34.

When the first connector assembly 14 is mated with the second connector assembly 18, the first electrical connector may be isolated from shock forces caused by the mating. For example, when the guide posts 42 mate with the guide modules 26, forces created by such mating may be isolated from the first electrical connector 22 and contained within the guide modules 26. Such isolation of the forces may occur because the guide modules 26 may not be mechanically attached directly to the first electrical connector 22. Accordingly, the first electrical connector 22 may be protected from any damage that may be caused by such mating forces. For example, the mounting ends of the electrical contacts in the first electrical connector 22 may not be damaged.

What is claimed:

1. An electrical connector assembly comprising:

first and second connector modules configured to be mounted on a circuit board, each of the connector modules comprising a connector housing, a leadframe assembly received in the connector housing, each leadframe assembly comprising a leadframe housing and an electrically-conductive contact extending through the leadframe housing, and an organizer that extends along a top surface of the leadframe assemblies, wherein the first and second connector modules are separated from each other by a gap that is sized to receive a first guide module;

wherein the organizer extends over the gap and covers the first guide module when the first guide module is disposed in the gap, and there is no direct mechanical attachment between the first connector module and the first guide module.

2. The electrical connector assembly of claim 1, wherein there is no direct mechanical attachment between the connector modules and the first guide module.

3. The electrical connector assembly of claim 1, wherein the first guide module is configured to be mounted on the circuit board in the gap.

4. The electrical connector assembly of claim 3, wherein the first and second connector modules are mounted on the circuit board, and the first guide module is mounted on the circuit board in the gap.

5. The electrical connector assembly of claim 4, wherein the first guide module defines an opening adapted to receive a first guide post.

6. The electrical connector assembly of claim 4, wherein the guide module protrudes further past an edge of the circuit board than the first connector module.

7. The electrical connector assembly of claim 5, further comprising a second guide module having an opening adapted to receive a second guide post, wherein (i) there is no direct mechanical attachment between the first connector module and the second guide module, and (ii) the first guide module is located at a first end of the first connector module and the second guide module is located at a second end of the first connector module.

8. The electrical connector assembly of claim 1, wherein the organizer includes a planar member that extends over the gap and covers the first guide module when the first guide module is disposed in the gap.

9. An electrical connector assembly comprising:

a first electrical connector configured to be mounted on a first circuit board such that the first electrical connector extends from the first circuit board to a first height;

a second electrical connector configured to be mounted on a second circuit board, the second electrical connector being adapted to mate with the first electrical connector;

a guide post configured to be mounted on the second circuit board at a location adjacent to the second electrical connector; and a first guide module configured to be mounted on the first circuit board, at a location adjacent to the first electrical connector on the first circuit board, such that the first guide module extends from the first circuit board to a second height that is less than the first height, the first guide module defining an opening configured to receive the guide post.

10. The electrical connector assembly of claim 9 wherein the first electrical connector comprises a first connector module and a second connector module.

11. The electrical connector assembly of claim 10 wherein (i) the first and second connector modules are connected by an organizer that extends over the first guide module, and (ii) there is no direct mechanical attachment between the organizer and the first guide module.

12. The electrical connector assembly of claim 10 wherein (i) the first and second connector modules are arranged such that a gap is defined between the first and second connector modules, and (ii) the first guide module is located in the gap.

13. The electrical connector assembly of claim 9 further comprising a second guide module having an opening adapted to receive a second guide post, wherein (i) there is no direct mechanical attachment between the first electrical connector and the second guide module, and (ii) the first guide module is located at a first end of the first electrical connector and the second guide module is located at a second end of the first electrical connector.

14. The electrical connector assembly of claim 9, wherein the first guide module and the first electrical connector are mounted on the first circuit board such that the first guide module protrudes further past an edge of the first circuit board than the first electrical connector.

15. The electrical connector assembly of claim 9 wherein the guide post is mounted on the second circuit board so that the guide post extends from the second circuit board.

16. The electrical connector assembly of claim 9 wherein the first guide module does not abut the first electrical connector when the first guide module and the first electrical connector are mounted on the first circuit board.

17. An electrical connector assembly comprising:

a first electrical connector configured to be mounted on a first circuit board;

a second electrical connector configured to be mounted on a second circuit board, the second electrical connector being adapted to mate with the first electrical connector;

a guide post configured to be mounted on the second circuit board at a location adjacent to the second electrical connector; and a guide module configured to be mounted on the first circuit board at a location adjacent to the first electrical connector, the guide module defining a first bottom surface that faces the first circuit board when the guide module is mounted on the first circuit board, a front portion that protrudes past the edge of the first circuit board when the guide module is mounted on the first circuit board, the front portion having a bottom portion that defines a second bottom surface that is disposed below the first bottom surface, and an opening configured to receive the guide post, wherein a spatial relationship between the first electrical connector and the guide module enables a force created by mating the guide post with the opening of the guide module to be isolated from the first electrical connector.

18. The electrical connector assembly of claim 17 wherein there is no direct mechanical attachment between the guide module and the first electrical connector.

19. The electrical connector assembly of claim 17 wherein the first electrical connector comprises a first connector module and a second connector module.

20. The electrical connector assembly of claim 19 wherein (i) the first and second connector modules are arranged such that a gap is defined between the first and second connector modules when the first and second connector modules are mounted on the first circuit board, and (ii) the guide module is located in the gap.

21. The electrical connector assembly of claim 17 wherein the front portion of the guide module protrudes further past an edge of the first circuit board than the first electrical connector when the guide module is mounted on the first circuit board.

22. The electrical connector assembly of claim 17 wherein the guide post extends from the second circuit board when the guide post is mounted on the second circuit board.

23. The electrical connector assembly of claim 17, wherein the bottom portion extends to a location below the upper surface of the first circuit board when the guide module is mounted on the first circuit board.

24. An electrical connector assembly of claim 18, wherein the bottom portion extends below the first circuit board when the guide module is mounted on the first circuit board.

* * * * *